US008365913B2

(12) United States Patent
Ceder

(10) Patent No.: US 8,365,913 B2
(45) Date of Patent: Feb. 5, 2013

(54) UNSTOPPERED BOTTLE WITH PROTECTION DEVICE

(75) Inventor: Julien Ceder, Reims (FR)

(73) Assignee: M H C S, Epernay (FR)

( * ) Notice: Subject to any disclaimer, the term of this patent is extended or adjusted under 35 U.S.C. 154(b) by 0 days.

(21) Appl. No.: 13/089,947

(22) Filed: Apr. 19, 2011

(65) Prior Publication Data

US 2012/0145591 A1 Jun. 14, 2012

(30) Foreign Application Priority Data

Dec. 8, 2010 (FR) ..... 10 60257

(51) Int. Cl.
*B65D 85/20* (2006.01)
*B65D 85/30* (2006.01)
*B65D 81/02* (2006.01)

(52) U.S. Cl. ..... 206/446; 206/588; 229/89

(58) Field of Classification Search ..... 206/427, 206/446, 521, 588–591; 215/11.3, 11.6, 215/12.1; 229/89–91; 261/76
See application file for complete search history.

(56) References Cited

U.S. PATENT DOCUMENTS 441,228 A * 11/1890 Cherbonnier ..... 229/90
922,413 A * 5/1909 Friedrich ..... 215/12.1
1,619,727 A * 3/1927 Hill ..... 206/446
1,957,677 A 5/1934 Soper et al.
3,613,761 A * 10/1971 Moody ..... 215/11.6
6,000,565 A * 12/1999 Ibeagwa ..... 215/11.6
6,053,317 A * 4/2000 Morris et al. ..... 229/91
6,568,660 B1 * 5/2003 Flanbaum ..... 261/76
7,311,201 B2 * 12/2007 Lo ..... 206/446
2007/0272581 A1 * 11/2007 Guelker et al. ..... 206/521

FOREIGN PATENT DOCUMENTS

| | | |
|---|---|---|
| CH | 560 632 | 4/1975 |
| EP | 0 911 270 | 4/1999 |
| FR | 2 549 009 | 1/1985 |
| WO | WO 2007/067766 | 6/2007 |

* cited by examiner

*Primary Examiner* — Bryon Gehman
(74) *Attorney, Agent, or Firm* — Miller Matthias & Hull LLP

(57) ABSTRACT

A liquid container comprising a bottle extends along a longitudinal axis X between a bottom of the bottle and a neck axially opposite to the bottom of the bottle. The container comprises a protection shell including a hollow body that is elongate along the longitudinal axis X and surrounding the bottle. The hollow body delimits an internal space extending axially from a first opening situated towards the bottom of the bottle to a second opening situated towards the neck. The protection shell also includes a cover blocking the first opening and arranged axially facing the bottom of the bottle. The neck is entirely contained in the space. The cover is fixed to the hollow body by a mechanical link that can be established manually.

21 Claims, 4 Drawing Sheets

UNSTOPPERED BOTTLE WITH PROTECTION DEVICE

CROSS-REFERENCE TO RELATED APPLICATIONS

This application claims priority under the Paris Convention to the French Patent Application No. 10 60257, filed on Dec. 8, 2010.

FIELD OF THE DISCLOSURE

The invention relates to the field of protection devices for vessels, in particular devices protecting glass bottles against impacts, and notably devices that can contain glass breakages should the bottle be broken.

BACKGROUND OF THE DISCLOSURE

The document FR 2549009 described a cladding shell, typically for a champagne bottle, that allows the neck of the bottle to pass through.

This type of device, primarily intended for decoration, does not provide optimal protection because it presents the drawback of still leaving the neck of the bottle exposed to any impacts. Now, vessels such as wine, champagne or beer bottles are commonly used in sensitive places such as on a lawn, a carpet, or around the edges of a swimming pool. In such places, the breaking of the bottle may be very prejudicial. For example, a splinter of glass falling into a swimming pool or around the edges of the latter may cause wounds and/or filtration apparatus malfunctions.

SUMMARY OF THE DISCLOSURE

One object of the present invention is to overcome this drawback by providing a protection device that protects all the bottle while being suited to the consumption of its content. The device according to the invention is particularly suited to places where the use of a glass vessel for the consumption of a drink is deprecated or prohibited, such as a swimming pool.

According to one embodiment, the container for liquid comprises a bottle, extends along a longitudinal axis between a bottom of the bottle and a neck axially opposite to the bottom of the bottle. The container comprises a protection device including a hollow body that is elongate along the longitudinal axis. The hollow body delimites an internal space surrounding the bottle from a first opening at the level of the bottom of the bottle to a second opening at the level of the neck. The protection device further includes a cover blocking the first opening and arranged axially facing the bottom of the bottle. The neck is entirely contained in the internal space. The cover is fixed to the hollow body by a mechanical link that can be established manually.

Advantageously, the mechanical link that can be established manually is chosen from a screw fitting, a snap fitting, a force fitting and a bayonet fixing.

Advantageously, the protection device comprises a centering surface cooperating with the bottom of the bottle in order to center the bottom in the hollow body. The centering surface may have a shape generated by rotation.

The shape generated by rotation may have radial ripples making it possible to hold the vessel radially. The centering surface may be fixed relative to the hollow body and thus oppose the movement of the vessel in the shell and any impact against the latter. Centering the end of the vessel opposite to the neck prevents the vessel from being held only by the axial abutment of the neck. This greatly reinforces the securing of the vessel in the shell. This is particularly useful for vessels with heavy bottoms such as champagne or equivalent bottles or glass wine bottles.

Advantageously, the neck comprises a free axial end and the hollow body has an axial abutment extending radially towards the interior of the hollow body, from the second opening, and axially facing the free end of the neck.

The axial abutment may be circular and extend from the second opening to cooperate with the free end of the neck, called the locking ring of the neck. This facilitates the seal between the neck and the shell.

Advantageously, the protection device comprises an axially urging device designed to axially push and keep the neck of the bottle tight against the axial abutment.

Advantageously, the axially urging device comprises a radial elastic element extending radially and a bottom circular flange extending axially between the radial elastic element and said cover, the radial elastic element having, on a side opposite to the bottom circular flange, one or more bearing regions for the bottle extending at a radial distance from the bottom circular flange.

The expression "at a radial distance" should be understood to mean that the radial distance relative to the axis between the bottom circular flange and each of the one or more bearing regions is greater than a predetermined non-zero threshold. Thus, the radial elastic element behaves like a spring subjected to the two opposing axial forces, one deriving from the vessel and the other from the bottom. This makes it possible to encase the dimensional fluctuations of the vessel to be protected without affecting the way in which the bottom blocks the first opening of the hollow body. For example, this radial distance may be greater than a thirtieth of the inscribed diameter of the first opening.

According to a variant, the container comprises a spacer separate from the radial elastic element, a centering surface for the bottom extending on one side of the spacer; the axially urging device also comprises one or more intermediate circular flanges extending axially between the side of the spacer opposite to the centering surface and the bearing region or regions of the radial elastic element, the intermediate circular flange or flanges being fixed either to the spacer or to the bearing region or regions of the radial elastic element.

According to another variant, said bearing region or regions of the radial elastic element are designed to center the bottom of the bottle. In this variant, the number of pieces to ensure the elastic pinning of the vessel in the shell is smaller.

Advantageously, the container comprises a molded chocking element made of elastomeric material, including a flat ring forming the radial elastic element and including the bottom circular flange. The central part of the flat ring may be completed by a spherical cap looping the central void of the bottom.

Advantageously, the protection device and, in particular, the centering surface, has a central protuberance directed towards the interior of the hollow body and a peripheral gutter.

Advantageously, the cover is removable.

Advantageously, the hollow body has an internal face of flared shape from the first opening to the second opening, said shape substantially hugging the external shape of the bottle. The internal surface thus ensures a centering of the bottle in the internal space of the hollow body. Other centering means are possible based on ribs protruding radially towards the interior of the housing.

Advantageously, the hollow body comprises an internal skirt and an external skirt, concentric and at a radial distance from one another, and fixed to one another respectively in the vicinity of the first opening and in the vicinity of the second opening. The dual protection skirt makes it possible to have a variable external skirt with specific markings or different esthetic finishing levels, while having an internal skirt particularly suited to the impact protection and/or thermal insulation function.

Advantageously, the container comprises a circular sealing gasket covering the axial abutment and axially compressed when the bottle is introduced into the hollow body.

Advantageously, the internal surface of the hollow body comprises a centering device designed to center the neck relative to the second opening.

Advantageously, the container comprises an elastomer sealing sleeve having a cylindrical portion and an axial abutment receiving the neck, the cylindrical portion being radially compressed between the neck and the internal face of the hollow body when the bottle is introduced into the hollow body.

Advantageously, the container comprises a pouring nozzle that has a tube that can be fitted in a leak tight manner in the neck. Advantageously, the pouring nozzle is made of a pliable synthetic material so that an impact on the pouring nozzle will not cause the bottle to break.

According to another aspect, the invention relates to a method of manufacturing a container for liquid in which the stopper is removed from a bottle, the unstoppered bottle is inserted into a hollow body through an opening in the hollow body, and said opening is blocked so that the unstoppered bottle is entirely contained in an internal space of the hollow body.

Advantageously, the unstoppered bottle is inserted into the internal housing while keeping the liquid in the bottle. Then, another stopper is introduced into the internal housing through a second opening in the hollow body and the bottle is restoppered.

BRIEF DESCRIPTION OF THE DRAWINGS

The present invention will be better understood on studying the detailed description of a few embodiments taken as non-limiting examples and illustrated by the appended drawings in which.

DETAILED DESCRIPTION OF THE DISCLOSURE

Figure 1:
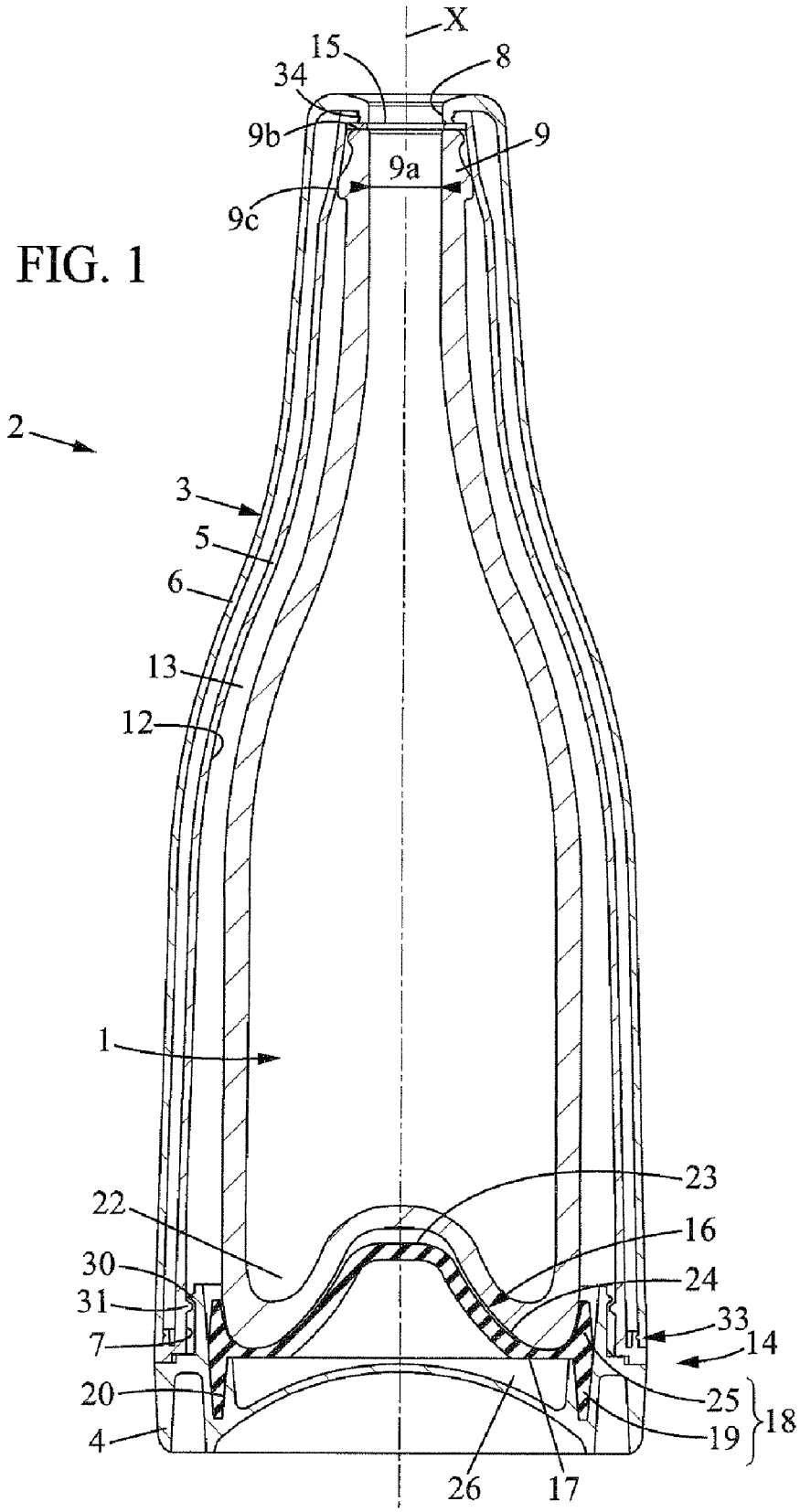
FIG. 1 is a longitudinal cross section of a first embodiment of a double-skirt shell.

As illustrated in FIG. 1, a bottle 1, typically a champagne bottle, is surrounded by a shell 2 having a hollow body 3 and a bottom 4. The hollow body comprises an internal skirt 5 and an external skirt 6 that are concentric and at a radial distance from one another. The assembly of the hollow body 3 with its two skirts has a flared shape corresponding to the external surface of the bottle 1. The hollow body 3 has a first opening 7 through which the bottle 1 is introduced. After this introduction, the bottom 4 is screwed into the hollow body 3 to block the first opening 7. The hollow body 3 further has a second opening 8 at the opposite end of the hollow body 3 and having a diameter substantially identical to the internal diameter 9*a* of the neck 9 of the bottle 1.

The hollow body 3 is elongate along an axis X and has an internal space 13 receiving the entire bottle 1. The axis X is concentric to the main axis of the bottle 1.

The assembly consisting of the hollow body 3 and the bottom 4 receives all the external surface of the bottle 1 from a bottom 22 of the bottle 1, the side wall of the bottle 1, to the locking ring 9*b* of the neck 9. The opening 8 is in axial alignment with the internal diameter 9*a* of the neck 9. The hollow body 3 has an internal end facing 11 extending radially perpendicularly to the axis X, and extends from the second opening 8, so as to cover the locking ring 9*b* of the bottle 1. The internal end facing 11 is thus an axial abutment 11*a* of circular shape extending on the internal face 12 of the hollow body 3.

The shell comprises a flat sealing gasket 15 arranged against the internal end facing 11 and sandwiched between the axial abutment 11*a* and the locking ring 9*b* of the bottle 1.

The length of the internal space 13 is suited to the axial length of the bottle 1. The shell 2 comprises a means 14 for axially pushing and keeping the neck 9 of the vessel tight against the axial abutment 11*a* equipped with the flat sealing gasket 15. The urging means 14 comprises a molded chocking element 16 made of elastomeric material. The chocking element 16 comprises a radial elastic element 17 in the shape of a flat ring which is concentric and perpendicular to the axis X. The chocking element 16 further comprises a circular flange 18 extending axially on either sides of the radial elastic element 17 and extending radially outside the radial elastic element 17. The circular flange 18 has a bottom circular flange 19 extending on a side opposite to the bottle 1 and being chocked into a housing 20 of the bottom 4 and having an annular shape complementing said bottom circular flange 19. The chocking element 16 has, on its side oriented towards the bottle 1, a centering surface 21 having a shape generated by rotation that is radially rippled and complementing the bottom 22 of the bottle 1.

The centering surface 21 has a central protuberance 23 and a peripheral gutter 24 delimited between the central protuberance and a top circular flange 25. The bottom 4 of the shell 2 has a central housing 26 extending radially at least in the most part from the radial elastic element 17 to radial proximity to the housing 20. Thus, when the bottom 4 is screwed into the hollow body 3, the bottle 1 is axially sandwiched between the centering surface 21 and the flat gasket 15. The radial fit of the bottom circular flange 19 in the housing 20 and the radial fit of the bottom of the bottle 22 with the top circular flange 25 and/or with the central protuberance 23 allows for a very good centering of the bottle 1 coaxially with the axis X of the shell 2. Furthermore, the central housing 26 of the bottom 4 enables the radial elastic element 17 to elastically collapse axially. This makes it possible to pin the locking ring 9*b* against the flat gasket 15 and to guarantee the seal preventing, when the user pours the liquid contained in the bottle 1, the latter from being introduced between the bottle 1 and the internal surface 12 of the hollow body 3.

Figure 2:
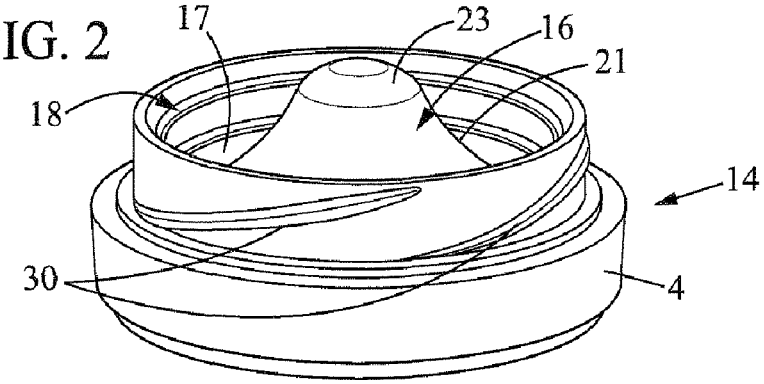
FIG. 2 is a perspective view of the axial chocking element and of the bottom of the first embodiment.
Figure 3:
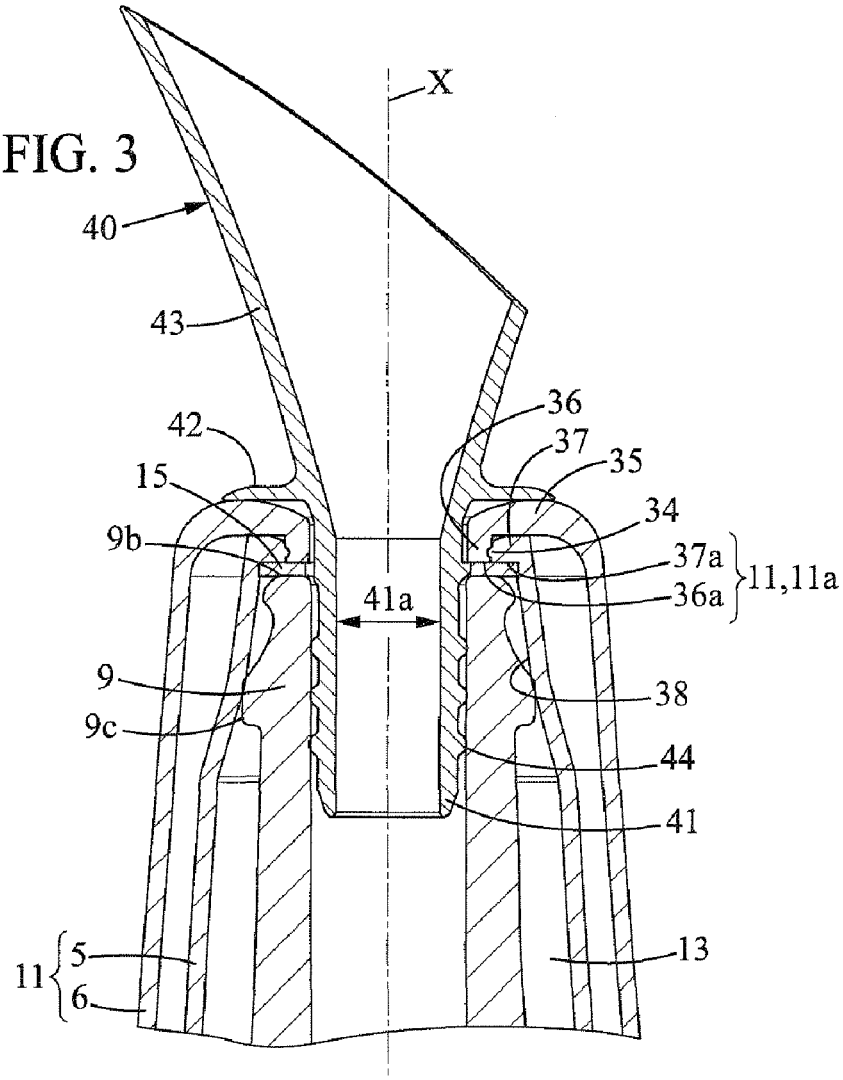
FIG. 3 is a detail of FIG. 1 showing the seal at the level of the neck according to a first embodiment and showing a first type of pouring nozzle.

As illustrated in FIGS. 1 and 2, the bottom 4 has external ribs 30 in the shape of a helix cooperating with as many regular beads 31 protruding radially towards the interior of the internal skirt 5. The beads 31 can be axially stripped by elastic deformation of the internal skirt 5.

The internal skirt 5 and the external skirt 6 are fixed to one another concentrically by two mutual centering/snap-fitting regions 33 and 34. Each of the centering/snap-fitting regions 33, 34 consists of an annular bead cooperating with an annular groove. The centering/snap-fitting region 33 is situated in proximity to the first opening 7 of the hollow body 3. In proximity to the second opening 8, the external skirt 6 has an end portion 35 axially looping the internal skirt 5 and an internal portion 36 forming an axial return towards the interior of the internal skirt 5. The portion 36 forming a return has a radially internal surface forming the second opening 8, a radially external face forming the centering/snap-fitting region 34 and an internal axial end 36*a* bearing on the flat gasket 15. The internal skirt 5 comprises an end 37, on the side of the neck 9, that snap fits axially with the external skirt 6 via the centering/snap-fitting region 34. The end 37 also has an internal end facing 37*a*, receiving the flat gasket 15, so that the pressure of the locking ring 9*b*, on the flat gasket 15, ensures the seal both between the neck 9 and the portion forming a return 36 of the external skirt 6 and the seal between the internal skirt 5 and the external skirt 6.

The shell 2 also comprises a means 38 for centering the neck 9 coaxially to the axis X of the hollow body 3. The centering means 38, in this embodiment, is formed by an internal side surface of the internal skirt 5 fitted to the external diameter of the neck 9.

Advantageously, the protection shell 2 also comprises a pouring nozzle 40 comprising an insertion tube 41, a radial bearing flange 42 and a pouring cone 43 extending in continuity with an internal diameter 41*a* of the insertion tube 41. The insertion tube 41 has external annular beads 44. The pouring nozzle 40 is molded as a whole from synthetic material so that the insertion tube 41 can be radially deformed in order for the beads 44 to ensure the seal with the internal diameter 9*a* of the neck 9. Furthermore, the material of the pouring nozzle 40 makes it possible to damp impacts that the pouring cone 43 might suffer so as not to cause the neck 9 to burst.

If we imagine the assembly illustrated in FIG. 1 being dropped on a sharp edge such as a swimming pool edge, it will be understood that the deformation of the external skirt 6, then that of the internal skirt 5 help to progressively dampen the violence of the impact before the deformation of the shell 2 reaches the bottle 1. At least the internal skirt 5 is made of a material that is sufficiently ductile for such an impact not to cause the internal skirt 5 to break. Thus, if the impact is sufficiently violent to ultimately cause the bottle 1 to break inside the shell 2, the glass debris of the broken bottle 1 remain contained within the internal skirt 5 of the hollow body 3.

Figure 4:
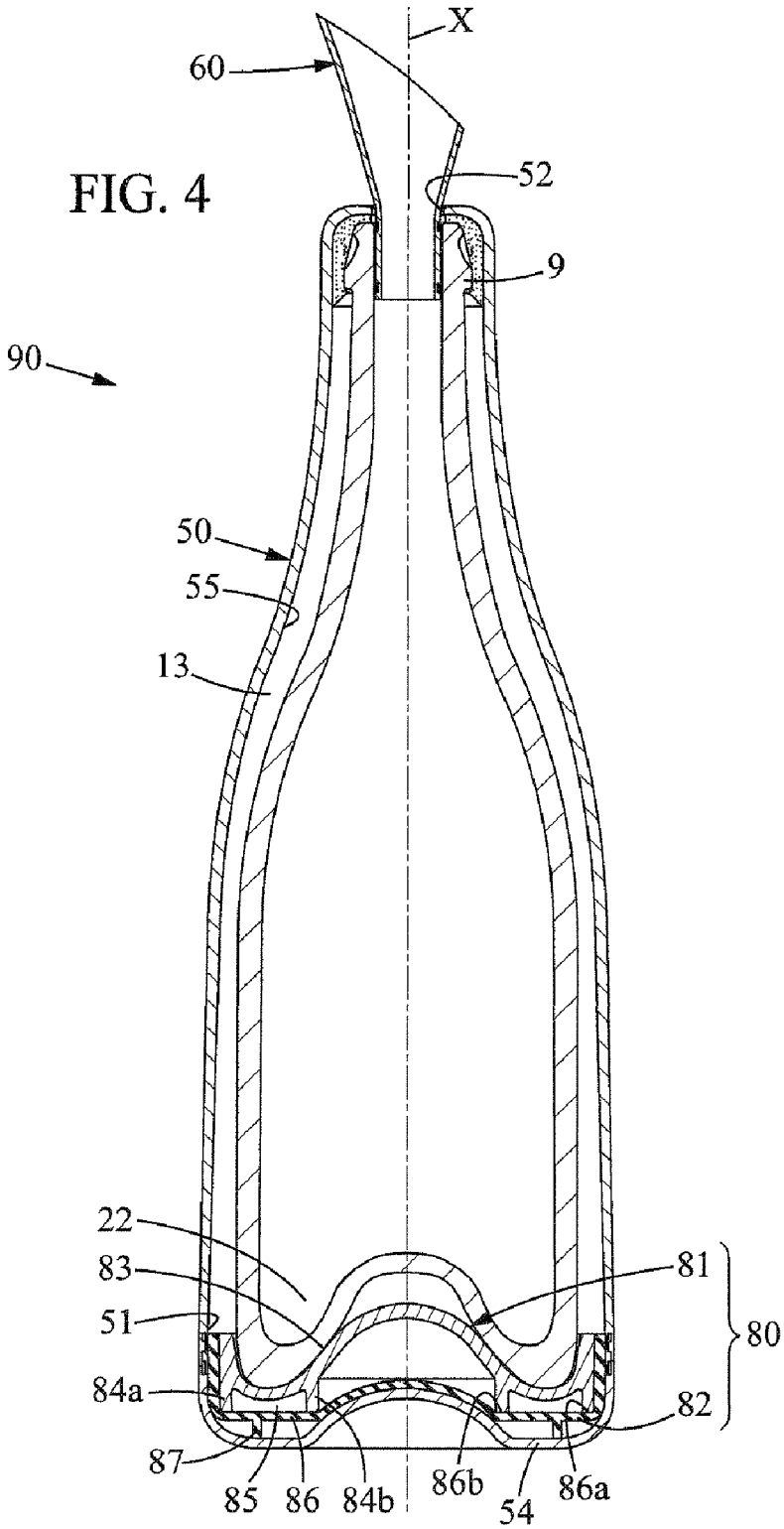
FIG. 4 is a longitudinal cross section of a second embodiment of a single-skirt shell.
Figure 5:
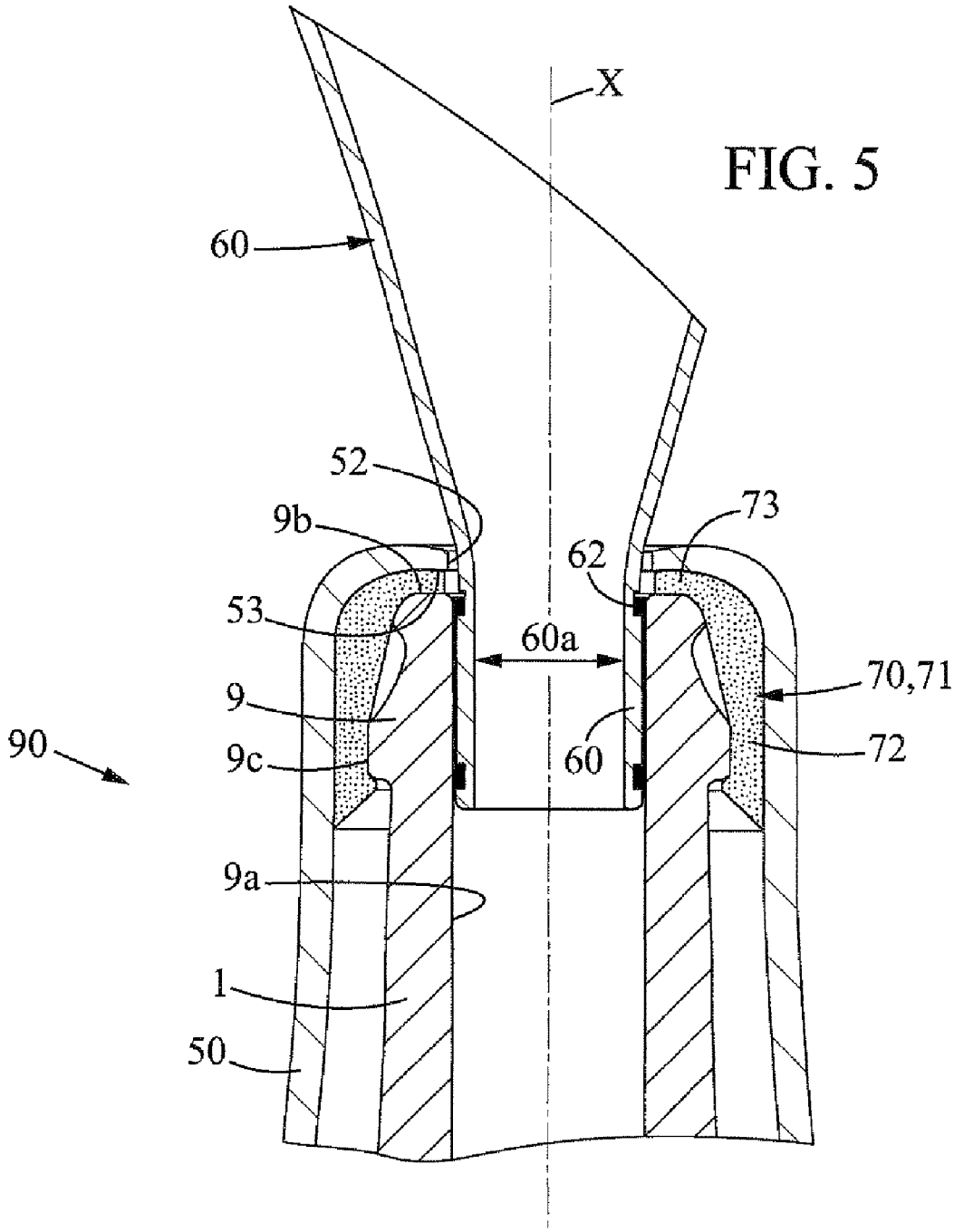
FIG. 5 is a detail of FIG. 4 showing another type of seal at the level of the neck and another type of pouring nozzle.

The second embodiment, illustrated in FIGS. 4 and 5, will make it possible to describe four means which shape as many variants that are independent of one another and that can be used together or separately by substituting the corresponding means in the embodiment described previously. The second embodiment comprises a hollow body 50 consisting of a single skirt, a pouring nozzle 60, a centering means 70 for the neck 9, and an axially urging means 80.

The hollow body 50 is a more economical version than the hollow body 3. It comprises a single skirt made of synthetic material. The hollow body 50 extends axially from a first opening 51 to a second opening 52 receiving the neck 9. The hollow body 50 extends axially in the vicinity of the first opening 51 and has lateral snap-fitting notches cooperating with a bottom 54 to block the first opening 51 after the bottle 1 has been introduced into the internal housing 13.

In the vicinity of the second opening 52, the hollow body extends radially. The second opening has a diameter substantially identical to the diameter 9*a* of the neck 9.

The centering means 70 for the neck 9 consists of an elastomer sealing sleeve 71 having a cylindrical portion 72 and a portion 73 extending radially, the whole hugging an internal surface of the hollow body 50 in the vicinity of the second opening 52. In this position, the radial portion 73 is sandwiched between the axial abutment 53 of the hollow body 50 and the locking ring 9*b* of the neck 9. Similarly, the cylindrical portion 72 has an internal diameter at rest that is less than an external diameter 9*c* of the neck 9 so that the introduction of the bottle 1 into the hollow body 50 is accompanied by the radial compression of the cylindrical portion 72, this radial compression ensuring the centering of the neck 9 coaxially to the axis X of the hollow body 50.

The axially urging means 80 is formed by the stacking of a spacer 81 on a radial elastic element 82 made of elastomeric material. The spacer 81 comprises, on the side receiving the bottle 1, a centering surface 83 with a shape generated by rotation that is radially rippled, with a central protuberance and a peripheral gutter corresponding to the bottom 22 of the bottle 1. The side of the spacer 81, opposite to the centering surface 83, has an external intermediate circular flange 84*a* and an internal intermediate circular flange 84*b* that are concentric and that both extend axially so as to form, between the intermediate circular flanges, an annular void 85.

The radial elastic element 82 comprises a flat ring 86 perpendicular to the axis X and extending radially from a bearing region 86*a*, on which rests the internal intermediate circular flange 84*a*, to a bearing region 86*b*, on which axially rests the internal intermediate circular flange 84*b*. The elastic radial element 82 also has a bottom circular flange 87 protruding from the flat ring 86 on the side opposite to the bearing surfaces 86*a* and 86*b*, and itself bearing on the bottom 54. Thus, when the bottom 54 is snap fitted onto the hollow body 50, the flat ring 86 ripples radially under the opposing pressure of the bottom circular flange 87 on one side and the two intermediate circular flanges 84*a* and 84*b* on the other. This radial ripple has a spring effect urging the bottle 1 against the axial abutment 53 through the elastomer spring-action sleeve 71.

The pouring nozzle 60 is a variant obtained by machining and/or by stamping which comprises an insertion tube 61 of the internal diameter 61*a* and having circular external grooves receiving two o-ring seals 62 to ensure the seal with the internal diameter 9*a* of the neck 9.

The internal surface 55 of the hollow body 50 extends radially at a distance from the bottle 1 so that an external impact on the hollow body 50 first causes a significant deformation of the hollow body 50 before reaching the bottle 1 in order for the impact to be damped thereby. If, despite this impact damping, the bottle 1 were to be broken, the debris of the bottle 1 would remain contained within the internal housing 13 of the hollow body 50.

The invention claimed is:

1. A container for liquid comprising:

a bottle extending along a longitudinal axis between a bottom of the bottle and a neck axially opposite to the bottom of the bottle; and a protection device which protects the bottle while being suited to the consumption of its content, said protection device including a hollow body extending along the longitudinal axis, wherein the hollow body delimits an internal space surrounding the bottle from a first opening situated at the level of the bottom to a second opening situated at the level of the neck, the neck being entirely contained in the internal space;

wherein the protection device further includes a cover blocking the first opening and arranged as to axially face the bottom of the bottle, the cover being fixed to the hollow body by a mechanical link that can be established manually; and wherein the protection device further comprises a sealing gasket having a cylindrical portion and an axial abutment receiving the neck, the cylindrical portion being radially compressed between the neck and an internal face of the hollow body when the bottle is introduced into said hollow body.

2. The container according to claim 1, in which the mechanical link that can be established manually is chosen from a screw fixing, a snap fitting, a force fitting and a bayonet fixing.

3. The container according to claim 1, in which the protection device comprises a centering surface cooperating with the bottom of the bottle in order to center said bottom in said hollow body.

4. The container according to claim 1, in which the protection device comprises a central protuberance directed towards the interior of the hollow body and a peripheral gutter.

5. The container according to claim 1, in which the cover is removable.

6. The container according to claim 1, in which the hollow body has an internal face of flared shape from the first opening to the second opening, said shape substantially hugging an external shape of the bottle.

7. The container according to claim 1, in which the hollow body comprises an internal skirt and an external skirt, concentric and at a radial distance from one another, and fixed to one another respectively in the vicinity of the first opening and in the vicinity of the second opening.

8. The container according to claim 1, comprising a centering device designed to center the neck relative to the second opening.

9. The container according to claim 1, comprising a pouring nozzle that has a tube that can be fitted in a leak tight manner in the neck.

10. A container for liquid comprising:

a bottle extending along a longitudinal axis between a bottom of the bottle and a neck axially opposite to the bottom of the bottle; and a protection device which protects the bottle while being suited to the consumption of its content, said protection device including a hollow body extending along the longitudinal axis, wherein the hollow body delimits an internal space surrounding the bottle from a first opening situated at the level of the bottom to a second opening situated at the level of the neck, the neck being entirely contained in the internal space;

wherein the protection device further includes a cover blocking the first opening and arranged as to axially face the bottom of the bottle, the cover being fixed to the hollow body by a mechanical link that can be established manually;

wherein the hollow body has an axial abutment extending radially towards the interior of said hollow body, from the second opening, and axially facing a free axial end of the neck, wherein the protection device comprises a circular sealing gasket covering the axial abutment and axially compressed when the bottle is introduced into the hollow body; and wherein the protection device comprises a central protuberance directed towards the interior of the hollow body and a peripheral gutter.

11. The container according to claim 10, in which the mechanical link that can be established manually is chosen from a screw fixing, a snap fitting, a force fitting and a bayonet fixing.

12. The container according to claim 10, in which the protection device comprises a centering surface cooperating with the bottom of the bottle in order to center said bottom in said hollow body.

13. The container according to claim 10, in which the protection device further comprises an axially urging device designed to axially push and keep the neck of the bottle tight against the axial abutment.

14. The container according to claim 13, in which the axially urging device comprises a radial elastic element extending radially and a bottom circular flange extending axially between the radial elastic element and said cover, the radial elastic element having, on a side opposite to the bottom circular flange, one or more bearing regions for the bottle extending at a radial distance from the bottom circular flange.

15. The container according to claim 14, comprising a spacer separate from the radial elastic element, a centering surface for the bottom extending on one side of the spacer; the axially urging device further comprising one or more intermediate circular flanges extending axially between the side of the spacer opposite to the centering surface and the bearing region or regions of the radial elastic element, the intermediate circular flange or flanges being fixed either to the spacer or to the bearing region or regions of the radial elastic element.

16. The container according to claim 14, in which said bearing region or regions of the radial elastic element are designed to center the bottom of the bottle.

17. The container according to claim 14, comprising a molded chocking element made of elastomeric material, including a flat ring forming the radial elastic element and including the bottom circular flange.

18. The container according to claim 10, in which the cover is removable.

19. The container according to claim 10, in which the hollow body comprises an internal skirt and an external skirt, concentric and at a radial distance from one another, and fixed to one another in the vicinity of the first opening and in the vicinity of the second opening.

20. The container according to claim 10, comprising a pouring nozzle that has a tube that can be fitted in a leak tight manner in the neck.

21. A method of manufacturing a container for liquid in which:

a bottle with a stopper is provided;

the stopper is removed from said bottle;

the unstoppered bottle is inserted into a hollow body through an opening in the hollow body, the inserted unstoppered bottle compressing a circular sealing gasket sealing part of the hollow body; and said opening is then blocked so that the inserted unstoppered bottle is entirely sealingly contained in an internal space of the hollow body.

* * * * *